US008648784B2

(12) United States Patent
Lee et al.

(10) Patent No.: US 8,648,784 B2
(45) Date of Patent: Feb. 11, 2014

(54) DEVICE AND METHOD FOR OVERDRIVING A LIQUID CRYSTAL DISPLAY

(75) Inventors: Wei-Kuo Lee, Hsinchu County (TW); Yi-Fan Chen, Taichung (TW)

(73) Assignee: Mstar Semiconductor, Inc., Hsinchu Hsien (TW)

( * ) Notice: Subject to any disclaimer, the term of this patent is extended or adjusted under 35 U.S.C. 154(b) by 318 days.

(21) Appl. No.: 12/963,329

(22) Filed: Dec. 8, 2010

(65) Prior Publication Data

US 2011/0080438 A1 Apr. 7, 2011

Related U.S. Application Data

(63) Continuation-in-part of application No. 11/513,274, filed on Aug. 31, 2006, now abandoned.

(30) Foreign Application Priority Data

Jan. 3, 2006 (TW) ..... 95100124 A

(51) Int. Cl.
*G09G 3/36* (2006.01)

(52) U.S. Cl.
USPC ..... 345/94; 345/87; 345/89; 345/204; 345/690

(58) Field of Classification Search
USPC ..... 345/87–104, 204–215, 690–699
See application file for complete search history.

(56) References Cited

U.S. PATENT DOCUMENTS 5,528,257 A * 6/1996 Okumura et al. ..... 345/99
7,382,349 B1 6/2008 Kuhns
7,405,741 B1 * 7/2008 Zhang et al. ..... 345/690
7,777,707 B2 * 8/2010 Halfant ..... 345/87
7,990,401 B2 * 8/2011 Li et al. ..... 345/690
8,345,055 B2 * 1/2013 Lu ..... 345/560
2003/0006949 A1 * 1/2003 Sekiya et al. ..... 345/87
2004/0017343 A1 * 1/2004 Adachi et al. ..... 345/87
2004/0263495 A1 * 12/2004 Sugino et al. ..... 345/204
2005/0068343 A1 * 3/2005 Pan et al. ..... 345/690
2005/0083353 A1 * 4/2005 Maruyama et al. ..... 345/690
2005/0162359 A1 7/2005 Sugino
2005/0162367 A1 * 7/2005 Kobayashi et al. ..... 345/98
2005/0184948 A1 * 8/2005 Halfant ..... 345/98
2005/0275611 A1 * 12/2005 Aoki ..... 345/96
2005/0280641 A1 * 12/2005 Kobayashi ..... 345/204
2006/0028492 A1 * 2/2006 Yamaguchi et al. ..... 345/690

(Continued)

FOREIGN PATENT DOCUMENTS

CN 1650342 A 8/2005

*Primary Examiner* — Gene W Lee
(74) *Attorney, Agent, or Firm* — Birch, Stewart, Kolasch & Birch, LLP

(57) ABSTRACT

The present invention relates to a device and a method for controlling a liquid crystal display. The device comprises a luminance weighting value processor, an overdrive value generator, and an outputting unit. The luminance weighting value processor generates a weighting value according to a luminance value of a current pixel of a current frame of a video signal and a luminance value of a previous pixel of a previous frame of the video signal. The overdrive value generator generates an overdrive value according to a current pixel value of the current pixel and a previous pixel value of the previous pixel. The outputting unit generates an output pixel value according to the weighting value, the overdrive value and the current pixel value. Using the device and the method for driving a liquid crystal display according to the present invention, noise due to overdrive process can be reduced.

10 Claims, 7 Drawing Sheets

(56) References Cited

U.S. PATENT DOCUMENTS

| | | | | |
|---|---|---|---|---|
| 2007/0063947 | A1* | 3/2007 | Kang | 345/89 |
| 2008/0068318 | A1* | 3/2008 | Kerwin | 345/89 |
| 2008/0212875 | A1* | 9/2008 | Lee et al. | 382/166 |
| 2008/0259059 | A1* | 10/2008 | De Greef | 345/204 |
| 2008/0279470 | A1* | 11/2008 | Warmuth et al. | 382/255 |
| 2009/0153456 | A1* | 6/2009 | Tsai et al. | 345/89 |
| 2010/0156772 | A1* | 6/2010 | Arashima et al. | 345/87 |
| 2010/0156955 | A1* | 6/2010 | Kimura | 345/690 |
| 2010/0164996 | A1* | 7/2010 | Tomizawa et al. | 345/690 |

* cited by examiner

DEVICE AND METHOD FOR OVERDRIVING A LIQUID CRYSTAL DISPLAY

CROSS REFERENCE TO RELATED APPLICATIONS

This application is a Continuation-in-Part of application Ser. No. 11/513,274 filed on Aug. 31, 2006 now abandoned, which claims priority to Application No. 095100124 filed in Taiwan, on Jan. 3, 2006. The entire contents of all of the above applications is hereby incorporated by reference.

BACKGROUND OF THE INVENTION

1. Field of the Invention:

The present invention generally relates to a device and a method for controlling a liquid crystal display and, more particularly, to a controlling circuit and a controlling method for overdriving a video signal in a liquid crystal display so as to eliminate image blur and improve the display quality.

2. Description of the Prior Art:

The user communicates with an electronic device through messages processed by the display of the electronic device so as to make the most of the electronic device. The computer is an example of such an electronic device.

The liquid crystal display (LCD) is the most popular display due to its small size and lightness. The LCD pixels are arranged in an array and each of the pixels is provided with electrodes so that a voltage is applied to the liquid crystal molecules for controlling the alignment of the liquid crystal molecules that determines the transmissivity of light passing the liquid crystal molecules. Accordingly, a video can be displayed by way of controlling the alignment of liquid crystal molecules.

Please refer to FIG. 1, which is a timing diagram showing the relation between the pixel voltage and the transmissivity of light, where the solid line represents the pixel voltage and the dotted line L represents the transmissivity of light. Due to the slow response time of the liquid crystal molecules, when the pixel voltage in a liquid crystal display is switched from V1 to V2, the liquid crystal molecules can not turn to a pre-determined direction for achieving a pre-determined transmissivity of light within a frame time (T), resulting in image blur.

In order to overcome image blur, a method for overdriving liquid crystal molecules is used in a liquid crystal display. Please refer to FIG. 2, which is a timing diagram showing the relation between the pixel voltage and the transmissivity of light when a conventional method for overdriving liquid crystal molecules is used. When the pixel voltage in a liquid crystal display is switched from V1 to V2, the liquid crystal molecules are accelerated by applying a higher voltage V3 to turn to a pre-determined direction so as to achieve a pre-determined transmissivity of light within a frame time (T). The response time of a liquid crystal display replies on the twisting speed of liquid crystal molecules. The faster the twisting speed, the shorter the response time.

However, the aforesaid technology still has some drawbacks. For example, when the frame is switched from a low luminance value to a high luminance value (much higher than the low luminance value), noise associated with the great amount of signals overdriven increases as the frame signals are overdriven. This leads to degraded video quality, which requires to be improved.

Therefore, there is need in providing a device and a method for controlling a liquid crystal display so as to improve the conventional technology for overdriving the video signal.

SUMMARY OF THE INVENTION

It is one object of the present invention to provide a controlling circuit for overdriving a video signal in a liquid crystal display, which takes a user-determined drivability into account and prevents the noise from increasing due to overdriving.

In order to achieve the foregoing object, the present invention provides a device for controlling a liquid crystal display, the device comprising: a luminance weighting value processor for calculating a weighting value according to a luminance value of a current pixel of a current frame of a video signal and a luminance value of a previous pixel of a previous frame of the video signal; an overdrive value generator for generating an overdrive value according to a current pixel value of the current pixel and a previous pixel value of the previous pixel; and an outputting unit for generating an output pixel value according to the weighting value, the overdrive value and the current pixel value.

The present invention further provides a method for controlling a liquid crystal display, providing a video signal comprising a current frame and a previous frame; calculating a weighting value according to a luminance value of a current pixel of the current frame and a luminance value of a previous pixel of the previous frame; generating an overdrive value according to a current pixel value of the current pixel and a previous pixel value of the previous pixel; and generating an output pixel value according to the weighting value, the overdrive value and the current pixel value.

BRIEF DESCRIPTION OF THE DRAWINGS

The objects, spirits and advantages of the preferred embodiment of the present invention will be readily understood by the accompanying drawings and detailed descriptions, wherein.

DETAILED DESCRIPTION OF THE PREFERRED EMBODIMENT

The present invention discloses a device and a method for overdriving a video signal in a liquid crystal display and can be exemplified by the preferred embodiment as described hereinafter.

Figure 1:
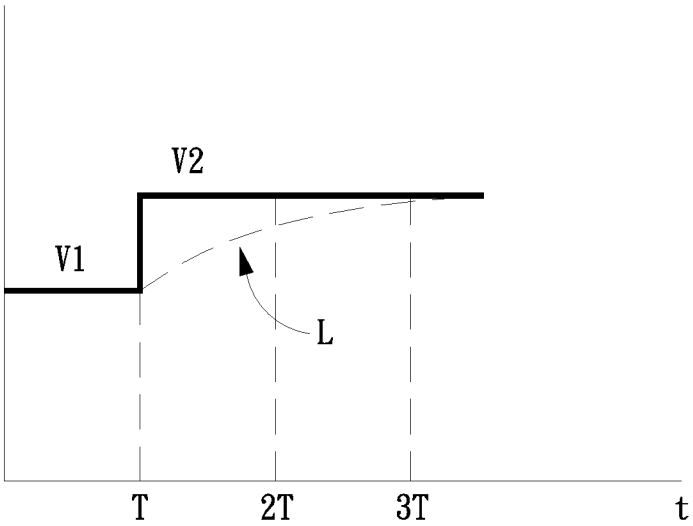
FIG. 1 is a timing diagram showing the relation between the pixel voltage and the transmissivity of light for explaining the image blur phenomenon in a conventional liquid crystal display.
Figure 2:
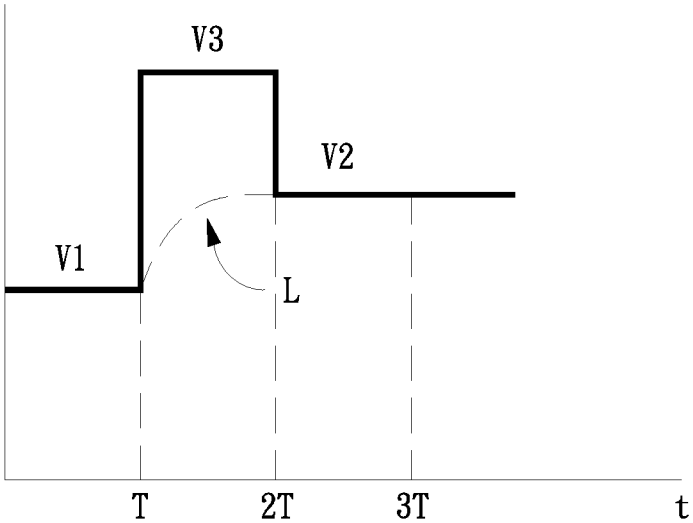
FIG. 2 is a timing diagram showing the relation between the pixel voltage and the transmissivity of light for eliminating the image blur phenomenon in a conventional liquid crystal display.
Figure 3:
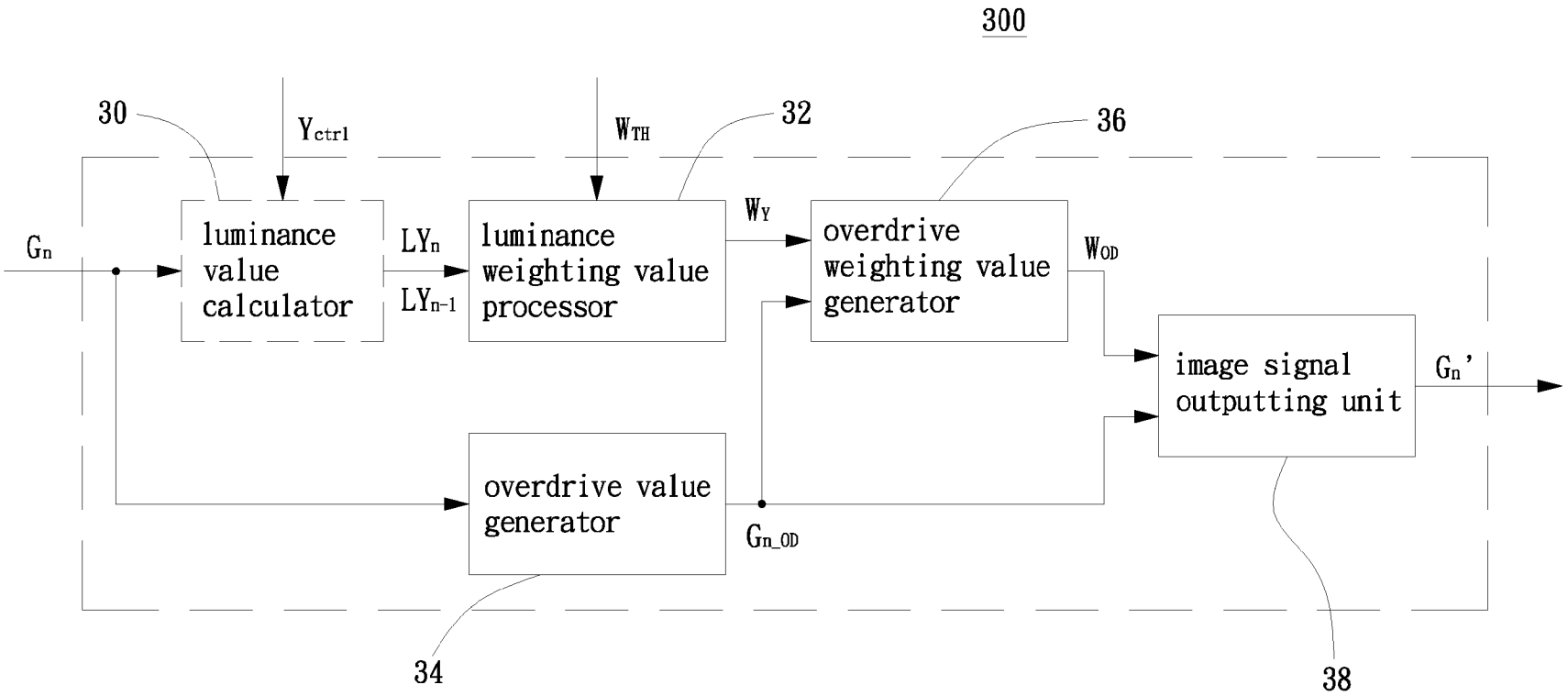
FIG. 3 is a functional block of a device for controlling a liquid crystal display according to an embodiment of the present invention.

Functionally, the device for controlling a liquid crystal display can be described with reference to the functional block shown in FIG. 3. The device 300 in FIG. 3 comprises a luminance weighting value processor 32, an overdrive value generator 34, an overdrive weighting value generator 36 and an outputting unit 38. In one embodiment, the device 300 of the present invention further comprises a luminance value calculator 30. The device 300 for controlling a liquid crystal display receives a video signal and applies a proper overdrive value to the video signal so as to output the video signal according to the comparison of a current frame and a previous frame of the video signal.

The luminance weighting value processor 32 calculates a luminance weighting value according to a luminance value $LY_n$ of a current pixel $G_n$ of a current frame and a luminance value $LY_{n-1}$ of a previous pixel $G_{n-1}$ of a previous frame of the video signal. The luminance values $LY_n$ and $LY_{n-1}$ can be obtained using the luminance value calculator 30. In one embodiment, the user adjusts the luminance values $LY_n$ and $LY_{n-1}$ by inputting a control signal $Y_{ctrl}$. The luminance value $LY_n$ of the current pixel $G_n$ and the luminance value $LY_{n-1}$ of the previous pixel $G_{n-1}$ are input into the luminance weighting value processor 32 so as to obtain a luminance weighting value $W_Y$. In one embodiment, the luminance weighting value processor 32 is implemented using a look-up table (LUT). A corresponding luminance weighting value $W_Y$ can be obtained using a pre-determined look-up table after the luminance value $LY_n$ of the current pixel $G_n$ and the luminance value $LY_{n-1}$ of the previous pixel $G_{n-1}$ are input into the luminance weighting value processor 32. Furthermore, a control signal $W_{TH}$ is input by the user into the luminance weighting value processor 32 so as to adjust the luminance weighting value. More particularly, the control signal $W_{TH}$ is a threshold signal in one embodiment so as to limit the luminance weighting value within a range. The control signal $W_{TH}$ is used to prevent the noise from being amplified while the video signal is being overdrived.

Figure 4:
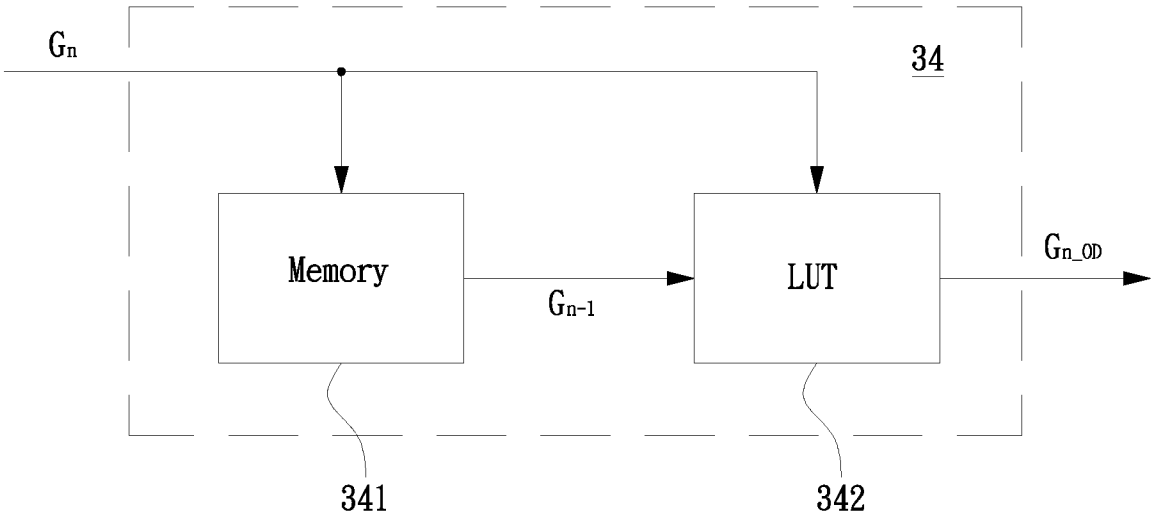
FIG. 4 is a functional block of an overdrive value generating unit of the device for controlling a liquid crystal display according to the present invention.

The overdrive value generator 34 generates an overdrive value to speed up the twisting of liquid crystal molecules. Please refer to FIG. 4, which is a functional block of an overdrive value generator 34 according to one embodiment of the present invention. The overdrive value generator 34 can comprise or access to a memory 341 for storing the video signal. After the pixel value of the current pixel $G_n$ of the video signal is input, the pixel value of the current pixel $G_n$ is stored in the memory 341 and then the pixel values of the current pixel $G_n$, and the previous pixel $G_{n-1}$ are input into the look-up table 342 so as to obtain a pre-determined overdrive value $G_{n_OD}$. The values stored in the look-up table 342 are pre-determined and stored in a memory. In another embodiment, a look-up table containing fewer values can be used with an interpolation circuit so as to obtain a proper overdrive value $G_{n_OD}$, while reducing the memory capacity required for the look-up table.

In order to prevent the noise from being amplified while overdriving the video signal, the device 300 for controlling a liquid crystal display according to the present invention comprises an overdrive weighting value generator 36 for generating an overdrive weighting value so as to limit and adjust the overdrive value and achieve noise reduction. The overdrive weighting value generator 36 generates a proper overdrive weighting value $W_{OD}$ according to the luminance weighting value $W_Y$ and the overdrive value $G_{n_OD}$. Therefore, an overdrive weighting value $W_{OD}$ for noise reduction is obtained based on the luminance and the overdrive value.

At last, the device 300 for controlling a liquid crystal display according to the present invention comprises an image signal outputting unit 38 for applying the overdrive value $G_{n_OD}$ and the overdrive weighting value $W_{OD}$ to the pixel value of the current pixel $G_n$ of the video signal so as to obtain an output pixel $G_n'$. In one preferred embodiment, the output pixel $G_n'$ can be expressed as:

$$G_n' = W_{OD} * G_{n_OD} + (1 - W_{OD}) * G_n.$$

Therefore, with the output pixel $G_n'$, the present invention achieves overdriving liquid crystal molecules and noise reduction.

Figure 5:
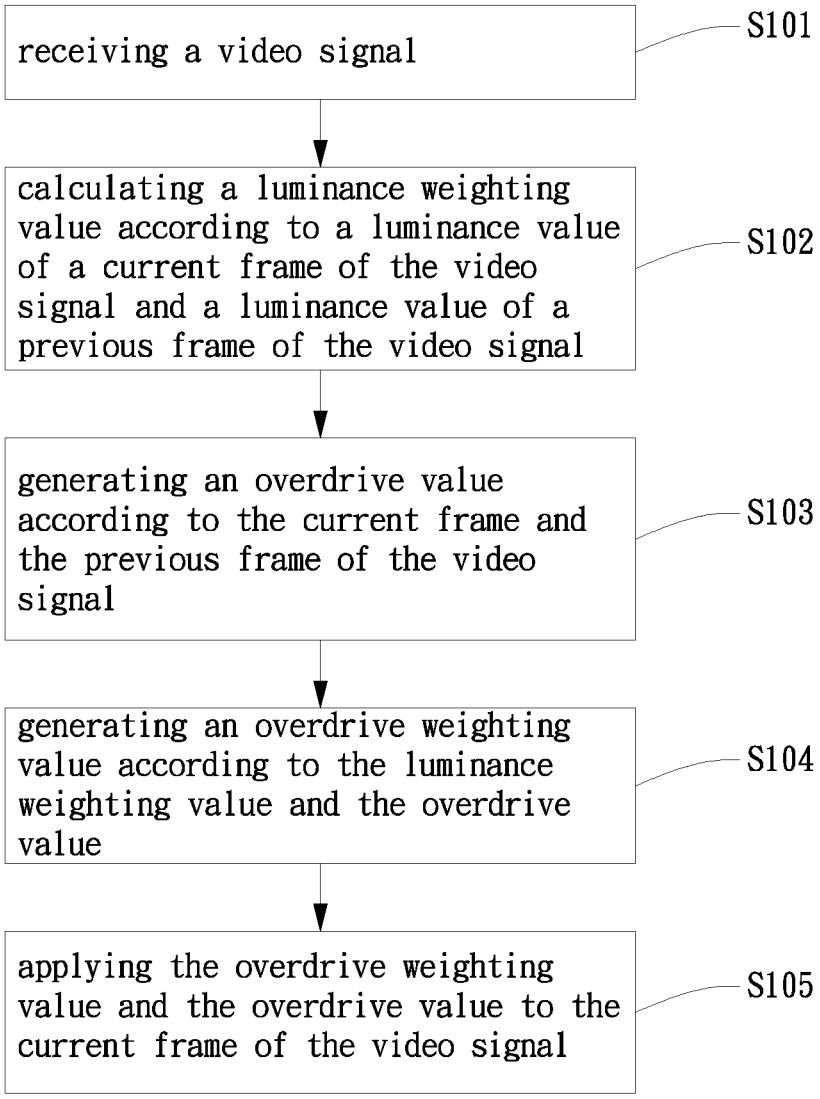
FIG. 5 is a flow-chart showing a method for controlling a liquid crystal display according to the present invention.

Please refer to FIG. 5, which is a flow-chart showing a method for controlling a liquid crystal display according to the present invention. First, as described in Step S101, a video signal composed of continuous frames is received.

Then, in Step S102, a luminance weighting value is calculated according to a luminance value of a current pixel value of a current pixel and a luminance value of a previous pixel value of a previous pixel in the continuous frames of the video signal. The luminance values of the input video signal are first calculated . The luminance weighting value can be obtained by using a pre-determined look-up table.

In Step S103, an overdrive value is generated according to the current pixel value and the previous pixel value. In one embodiment, an overdrive value can be looked up in a pre-determined look-up table according to the pixel values of the current pixel and the previous pixel of the video signal.

However, in another embodiment, a look-up table containing fewer values can be used with interpolation so as to obtain a proper overdrive value, while reducing the memory capacity required for the look-up table.

In Step S104, an overdrive weighting value is generated according to the luminance weighting value and the overdrive value. In order to prevent the noise from being amplified while overdriving the video signal, the present invention uses an overdrive weighting value so as to limit and adjust the overdrive value and achieve noise reduction. The overdrive weighting value is obtained based on the luminance and the overdrive value.

Finally, in Step S105, the overdrive weighting value and the overdrive value are applied to the pixel value of the current pixel of the video signal to generate an output pixel value of the current pixel. The overdrive weighting value and the overdrive value are applied to the current pixel of the video signal so that the video signal is overdrived to eliminate image blur and the noise due to overdrive can be prevented by the overdrive weighting value.

Figure 6:
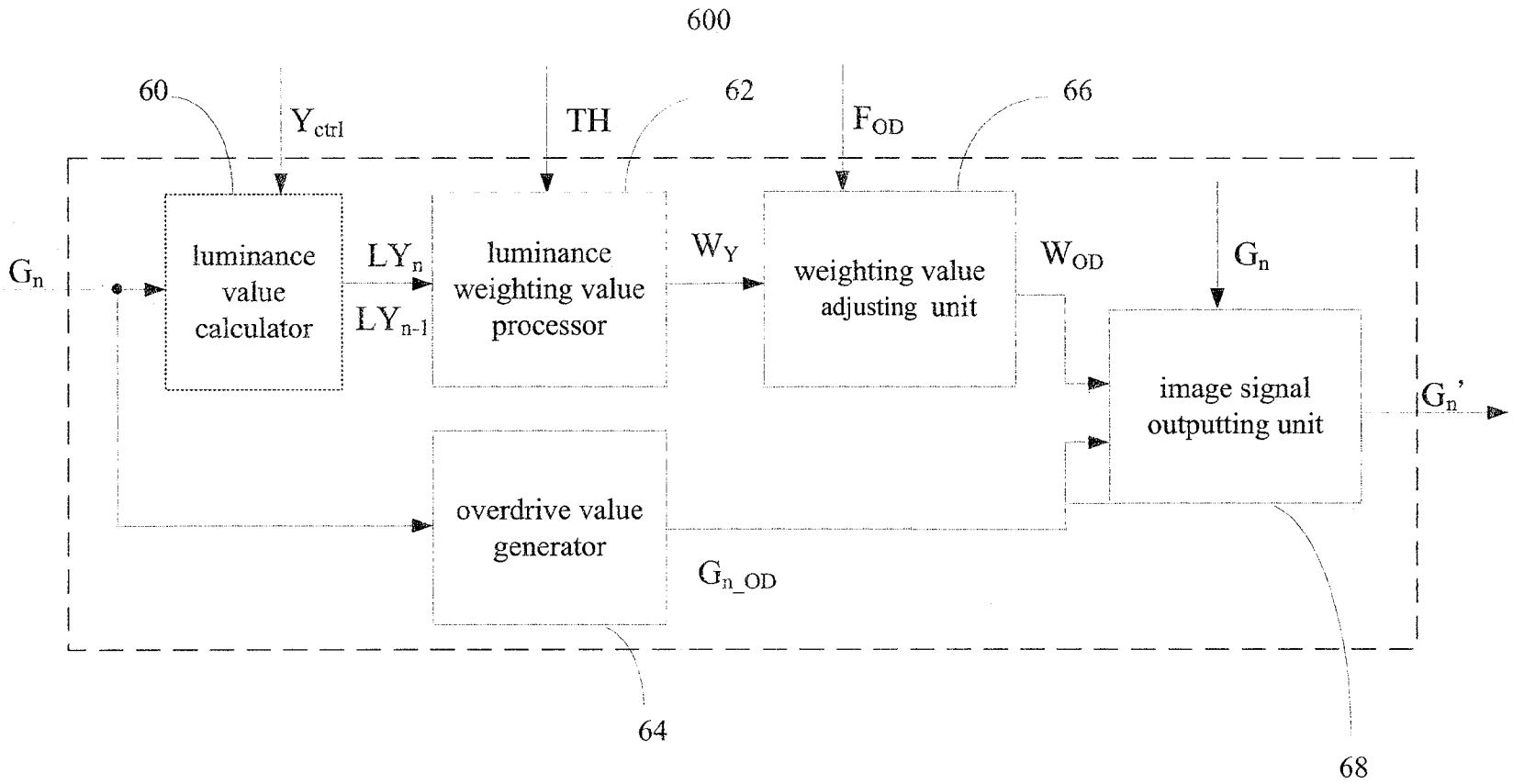
FIG. 6 is a functional block of a device for controlling a liquid crystal display according to another embodiment of the present invention.
Figure 7:
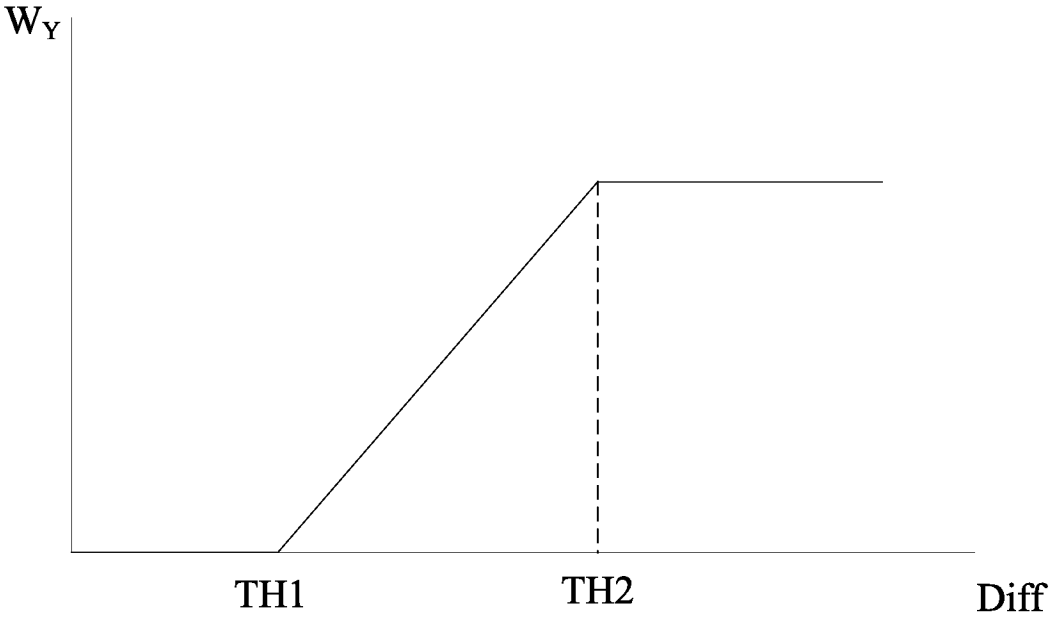
FIG. 7 shows the relationship between the weighting value $W_Y$ and the difference Diff according to an embodiment of the present invention.

FIG. 6 shows a functional block of a device for controlling a liquid crystal display according to another embodiment of present invention. The device 600 comprise a luminance value calculator 60, a luminance weighting value processor 62, an overdrive value generator 64, a weighting value adjusting unit 66, and an image signal outputting unit. The luminance value calculator 60 calculates a luminance value of each of pixels of a current frame and a previous frame. For example, the luminance value calculator 60 can obtain a luminance of a certain pixel according to its red (R), green (G), and blue (B) pixel values. The luminance weighting value processor 62 generates a weighting value $W_Y$ according to a luminance value of a current pixel of the current frame and a luminance value of a previous pixel of the previous frame. Generally speaking, the weighting value $W_Y$ is associated with a difference Diff between the luminance value of the current pixel and the luminance value of the previous pixel. When the difference Diff between the luminance value of the current pixel and the luminance value of the previous pixel is rather small, it means that the corresponding pixel may belong to a static image. If providing a large overdrive value to a pixel belonging to a static image, the image noise will be enlarged. To avoid enhancing and enlarging image noise, the weighting value $W_Y$ is generated with a small value or even being equivalent to zero when the difference Diff between the luminance value of the current pixel and the luminance value of the previous pixel is less than a threshold TH1. When the difference Diff is large than the threshold TH1, the weighting value $W_Y$ can increase with the difference Diff. In one embodiment, the relationship between the weighting value $W_Y$ and the difference Diff between the luminance value of the current pixel and the luminance value of the previous pixel can be showed as FIG. 7.

The weighting value adjusting unit 66 adjusts the weighting value according to a factor $F_{OD}$ which can be set by a user to modify the strength of the overdrive process and/or to correct the pixel value. In practice, the weighting value adjusting unit 66 can adjust the weighting value by timing the factor $F_{OD}$ or adding and/or subtracting the factor $F_{OD}$. Therefore, a user can use the factor $F_{OD}$ to modify the strength of the overdrive process and correct the pixel value without changing the look-up table of the overdrive value generator 64. It is to be noted that the weighting value adjusting unit 66 can be omitted in other embodiments of the present invention.

The overdrive value generator 64 generates an overdrive value $G_{n_OD}$ according to a current pixel value $G_n$ of the current pixel and a previous pixel value $G_{n-1}$ of the previous pixel. It is to be noted that, operations of the overdrive value generator 64 is similar to those of the overdrive value generator 34, and shall not be described for brevity.

The image signal outputting unit 68 generates and outputs an output pixel value according to the weighting value, the overdrive value and the current pixel value. In one embodiment, the output pixel value $G_n'$ can be expressed as:

$$G_n' = W_{OD} * G_{n_OD} + (1 - W_{OD}) * G_n$$

Where, $W_{OD}$ represents the adjusted weighting value output by the weighting value adjusting unit 66.

Although this invention has been disclosed and illustrated with reference to particular embodiments, the principles involved are susceptible for use in numerous other embodiments that will be apparent to persons skilled in the art. This invention is, therefore, to be limited only as indicated by the scope of the appended claims.

What is claimed is:

1. A device for controlling a liquid crystal display, the device comprising:

a luminance weighting value processor for generating a weighting value according to a luminance value of a current pixel of a current frame of a video signal and a luminance value of a previous pixel of a previous frame of the video signal;

an overdrive value generator for generating an overdrive value according to a current pixel value of the current pixel and a previous pixel value of the previous pixel;

an outputting unit for generating an output pixel value according to the weighting value, the overdrive value and the current pixel value; and a weighting adjusting unit, coupled between the luminance weighting value processor and the outputting unit, for adjusting the weighting value according to a predetermined factor, wherein the output pixel value is defined as:

$$G_n' = W_{OD} * G_{n_OD} + (1 - W_{OD}) * G_n$$

where $G_n'$ represents the output pixel value, $W_{OD}$ represents the adjusted weighting value, $G_{n_OD}$ represents the overdrive value, and $G_n$ represents the current pixel value.

2. The device as recited in claim 1, further comprising: a luminance value calculator for calculating the luminance value of the current pixel and the luminance value of the previous pixel.

3. The device as recited in claim 1, wherein the weighting value is associated with a difference between the luminance value of the current pixel and the luminance value of the previous pixel.

4. The device as recited in claim 1, wherein the previous frame of the video signal is stored in a memory.

5. The device as recited in claim 1, wherein the overdrive value generator comprises a first look-up table (LUT) for generating the overdrive value.

6. The device as recited in claim 5, wherein the first look-up table is stored in a first memory.

7. The device as recited in claim 6, wherein the overdrive value generator comprises an interpolation circuit.

8. A method for controlling a liquid crystal display, the method comprising:

providing a video signal comprising a current frame and a previous frame;

generating a weighting value according to a luminance value of a current pixel of the current frame and a luminance value of a previous pixel of the previous frame;

generating an overdrive value according to a current pixel value of the current pixel and a previous pixel value of the previous pixel;

adjusting the weighting value according to a predetermined factor; and after the step of adjusting the weighting value, generating an output pixel value according to the weighting value, the overdrive value and the current pixel value, wherein the output pixel value is defined as:

$$G_n' = W_{OD} * G_{n_OD} + (1 - W_{OD}) * G_n$$

where $G_n'$ represents the output pixel value, $W_{OD}$ represents the adjusted weighting value, $G_{n\ OD}$ represents the overdrive value, and $G_n$ represents the current pixel value.

9. The method as recited in claim 8, further comprising: calculating the luminance value of the current pixel and the luminance value of the previous pixel.

10. The method as recited in claim 8, wherein the weighting value is associated with a difference between the luminance value of the current pixel and the luminance value of the previous pixel.

* * * * *